United States Patent [19]

Robinson

[11] Patent Number: 4,823,487

[45] Date of Patent: Apr. 25, 1989

[54] RESILIENT FLEX PIN APPARATUS FOR EXCAVATING TOOTH POINT AND ADAPTER ASSEMBLIES

[75] Inventor: Howard W. Robinson, Grapevine, Tex.

[73] Assignee: GH Hensley Industries, Inc., Dallas, Tex.

[21] Appl. No.: 79,354

[22] Filed: Jul. 30, 1987

[51] Int. Cl.[4] ..... E02F 9/28

[52] U.S. Cl. ..... 37/142 A; 403/225; 403/291; 411/514

[58] Field of Search ..... 37/141 R, 141 J, 142 A, 37/142 R; 403/225, 291, 379; 411/512–515

[56] References Cited

U.S. PATENT DOCUMENTS

| | | | |
|---|---|---|---|
| 2,927,387 | 3/1960 | Drover | 37/142 |
| 3,126,654 | 3/1964 | Eyolfson et al. | 37/142 |
| 3,437,003 | 4/1969 | Rhoads | 37/142 A X |
| 3,520,224 | 7/1970 | Hensley et al. | 37/142 A X |
| 3,526,049 | 9/1970 | Nichols | 37/142 |
| 3,685,178 | 8/1972 | Ratkowski | 37/142 |
| 4,077,729 | 3/1978 | Schwappach | 37/142 A X |
| 4,192,089 | 3/1980 | Schwappach | 37/142 |
| 4,261,619 | 4/1981 | Howe et al. | 37/142 A X |
| 4,446,638 | 5/1984 | Novotny et al. | 37/142 A |
| 4,663,867 | 5/1987 | Hahn et al. | 37/142 A |

FOREIGN PATENT DOCUMENTS

| | | | |
|---|---|---|---|
| 1918491 | 12/1970 | Fed. Rep. of Germany | 37/142 A |

*Primary Examiner*—Edgar S. Burr
*Assistant Examiner*—Moshe I. Cohen
*Attorney, Agent, or Firm*—Hubbard, Thurman, Turner & Tucker

[57] ABSTRACT

A flex pin includes an elongated rigid locking member having an elongated lateral recess formed therein. An elongated rigid wedge member is intersecured to the locking member by means of a spaced series of elastomeric segments positioned in the recess, and is laterally movable into the recess against the resilient resistance of the elastomeric segments. The wedge member has a longitudinally intermediate portion which is engageable by a forward side surface of the adapter nose opening and is interlockable therewith, and a pair of rearwardly swept outer end portions which underlie opposite end surfaces of the locking member recess and are engageable therewith as the flex pin is being driven into its installed position to prevent shearing of the elastomeric segments. When the wedge member is laterally driven into the locking member recess, by relative movement between the tooth point and adapter, a pair of stop projections formed on the rear recess side surface engage the longitudinally intermediate wedge member portion and stop the inward wedge member travel before the outer end portions thereof engage the rear side surface of the recess, thereby essentially eliminating rigid bending loads on the wedge member.

38 Claims, 4 Drawing Sheets

RESILIENT FLEX PIN APPARATUS FOR EXCAVATING TOOTH POINT AND ADAPTER ASSEMBLIES

BACKGROUND OF THE INVENTION

The present invention relates generally to earth excavating equipment, and more particularly provides an improved flex pin that is used to captively retain a replaceable excavating tooth point on the nose portion of an adapter which, in turn, is secured to the forward lip of an excavating bucket or the like.

Excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interengageable elements adjacent the rear end of the point, and a device commonly referred to as a flex pin is driven into these openings.

While flex pins have a variety of configurations, a widely used version, as representatively illustrated in U.S. Pat. No. 3,526,049 to Nichols and U.S. Pat. No. 3,685,178 to Ratkowski, typically comprises elongated, straight metal locking and wedge members which are laterally spaced apart and intersecured by an elongated central elastomeric element. As the flex pin is being driven into the aligned point and adapter nose openings the elastomeric element is compressed and, when the pin is driven to its installed position, laterally urges a detent portion formed on one of the two metal portions of the pin into engagement with a suitably configured portion of the adapter nose to captively retain the flex pin within the point and adapter openings. With the flex pin in its operative position within such openings, the elastomeric element is in a state of partial compression, rear surfaces of the tooth point openings bear against opposite end portions of the locking member, and a forward surface of the adapter nose opening bears against a longitudinally central portion of the wedge member. Forwardly directed tooth point removal forces encountered during the excavating process cause the tooth point to be driven forwardly relative to the adapter to thereby move the locking member closer to the wedge member and further compress the central elastomeric element, the opposite ends of the locking member preventing forward removal of the tooth point.

Two primary problems and disadvantages are present in this type of conventional flex pin construction—each of which is related to failure of the central elastomeric element. First, as the flex pin is being driven into the aligned tooth point and adapter nose openings the locking and wedge members tend to be moved longitudinally relative to one another. Thus, if the driving-in process is not carefully performed, this relative longitudinal movement can easily shear the elastomeric element, thereby ruining the flex pin. Secondly, excessive forwardly directed tooth point removal loads can laterally move the locking member close enough to the wedge member to overcompress and thereby split the elastomeric element.

Various attempts have previously been made to better protect the critical central elastomeric portion of the flex pin by altering the essentially straight configurations of the locking and wedge member portions utilized in flex pin structures such as those depicted in the Nichols and Ratkowski patents. One such proposed solution, as exemplified in U.S. Pat. No. 4,192,089 to Schwappach and U.S. Pat. No. 4,446,638 to Novotny et al, is to form a central lateral recess in a front side portion of the locking member and to shorten the wedge member so that it is laterally movable into such recess against the resilient force of the central elastomeric element. With the elastomeric element in an uncompressed condition the opposite ends of the wedge member underlie the opposite end surfaces of the recess so that as the flex pin is being driven into the point and adapter openings one of the wedge member ends is driven into engagement with its adjacent recess end surface. This limits the relative longitudinal travel between the locking and wedge members to thereby limit the shear stress imposed upon the elastomeric element.

In an attempt to similarly limit the lateral compressive stress imposed on the elastomeric element, the maximum distance which the wedge member may be laterally moved into the locking member recess is limited to a distance less than the front-to-rear thickness of the elastomeric element by causing opposite end portions of the wedge member to rigidly engage portions of the locking member during travel of the wedge member into the locking member recess. In the Schwappach patent this inward travel limitation is achieved by forming on the opposite wedge member ends rearwardly directed projections which are engageable with the rear side surface of the locking recess. In the Novotny et al patent a similar result is achieved by forming forwardly facing shoulders positioned adjacent opposite ends of the recess which are adapted to rigidly engage opposite end portions of the wedge member during its lateral travel into the recess. Somewhat similar schemes for protecting elastomeric flex pin portions are evidenced in U.S. Pat. No. 2,927,387 to Drover and U.S. Pat. No. 3,126,654 to Eyolfson et al.

While this conventional method of limiting lateral compression of the elastomeric element represents an improvement over somewhat simpler flex pin structures such as those depicted in the Nichols and Ratkowski patents, it creates significant structural problems in the wedge member. Specifically, when the wedge member is moved to its "stopped" position within the locking member recess a large rigid bending load is imposed thereon by the forward surface of the adapter nose opening which bears against a central rear side portion of the wedge member. To adequately strengthen the wedge member against such bending load it is necessary to appropriately increase its front-to-rear thickness. This thickening, in turn, typically requires that undesirable design modifications be made to one or all of the elastomeric element, the locking member and the adapter nose opening.

Specifically, it is well known that the overall strength of an adapter nose is, generally speaking, inversely proportional to the size of the flex pin opening formed therethrough. Thus, if it desired to maintain a given front-to-rear length of the adapter nose opening, the necessary thickening of the wedge member requires that the front-to-rear thickness of one or both of the elastomeric element and the locking member be correspondingly reduced. Reducing the thickness of the locking member, of course, structurally weakens the flex pin, while reducing the thickness of the elastomeric element reduces the resiliency of the flex pin and the potential lateral travel between its rigid elements. Of course, neither of these results is desirable.

If, on the other hand, the front-to-rear thicknesses of the elastomeric element and the locking member are maintained, the thickening of the wedge member requires that the front-to-rear length of the adapter nose opening be correspondingly increased. This, of course, undesirably weakens the adapter nose.

In view of the foregoing, it is accordingly an object of the present invention to provide improved resilient flex pin apparatus which eliminates or minimizes the above-mentioned and other problems, limitations and disadvantages heretofore associated with flex pins of conventional design and construction.

SUMMARY OF THE INVENTION

In carrying out principles of the present invention, in accordance with a preferred embodiment thereof, an improved resilient flex pin is provided which may be driven into generally aligned openings extending through an excavating tooth point and its associated adapter nose to captively retain the point on the adapter nose. The improved flex pin comprises an elongated rigid locking member having an elongated recess extending laterally into a forward side surface thereof, and a pair of opposite end portions adapted to be engaged by rear surface portions of the tooth point openings. An elongated rigid wedge member is laterally movable into the locking member recess, toward its elongated rear side surface, and is secured to the locking member by resilient means interposed between the rear recess side surface and a rearwardly facing side surface of the wedge member. These resilient means are preferably defined by a longitudinally spaced series of elastomeric elements having openings defined therebetween into which portions of the elastomeric material may be displaced as the locking and wedge members are forced laterally towards each other.

The wedge member has a longitudinally intermediate portions which is adapted to be engaged by a forward surface portion of the adapter nose opening, and a pair of rearwardly swept outer end portions whose outer end surfaces underlie the opposite end surfaces of the locking member recess. As the improved flex pin is being driven into the tooth point and adapter nose openings, one of these outer wedge member end surfaces is driven against its adjacent recess end surface to limit the relative longitudinal movement between the locking and wedge members, thereby limiting the longitudinal shear stress imposed upon the resilient means. To captively retain the improved flex pin within the tooth point and adapter nose openings, suitable retention means are provided which, in the preferred embodiment of the improved flex pin, comprise a forwardly projecting detent formed on the longitudinally intermediate portion of the wedge member and receivable in a complementarily configured detent recess formed in a forward side surface portion of the adapter nose opening.

According to an important feature of the present invention, rigid stop means are interposed between the facing side surfaces of the locking member recess and the longitudinally intermediate portion of the wedge member and function to stop the lateral travel of the wedge member into the locking member recess at an inner limit position in which the outer end portions of the wedge member are spaced forwardly from and not engaged by the rear side surface of the recess, or any other surface portion of the recess.

In this inner limit position, the longitudinally intermediate wedge member portion is pressed between the forward side surface of the adapter nose opening and these central stop means which are, in turn, pressed between the rear side surfaces of the locking member recess and the longitudinally intermediate wedge member portion. In the preferred embodiment of the improved flex pin, the central stop means comprise a spaced pair of forward projections formed on the rear side surface of the locking member recess, positioned directly behind the longitudinally intermediate wedge member portion, and extending into a pair of the lateral voids or openings positioned between adjacent pairs of the elastomeric resilient means elements. Alternatively, the central stop means could comprise rearward projections formed on the longitudinally intermediate wedge member portion, or rigid stop members imbedded in the spaced apart elastomeric elements.

Importantly, these centrally positioned stop means uniquely operate to essentially eliminate the imposition of appreciable rigid bending loads on the wedge member in its inner limit position. Since the outer end portions of the wedge member are at no time laterally brought into engagement with any surface of the locking member recess, the central lateral force of the adapter nose on the wedge member does not result in a bending load on the wedge member.

Because of this important feature, the front-to-rear thickness of the wedge member may be significantly reduced compared to that of counterpart wedge members in flex pins of conventional construction. Accordingly, either or both of the resilient means and the locking member in the improved flex pin may be thickened in such front-to-rear direction, to strengthen the flex pin and/or increase its resiliency, without the necessity of increasing the front-to-rear dimension of the adapter nose pin opening.

In accordance with another aspect of the present invention, axially extending guide notches are formed in the opposite ends of the locking member. These notches are adapted to receive an inner end of a drift member (or other similar driving member) used to pound the flex pin out of the tooth point and adapter nose openings when it becomes necessary to replace the tooth point, and function to prevent the drift from slipping out of engagement with the flex pin while it is being pounded out.

In a slightly modified version of the improved flex pin, a forward side portion thereof is made somewhat narrower than the balance of the pin. By accordingly narrowing front end portions of the tooth point openings, a "key" effect is achieved such that the flex pin can only be inserted into either of the point openings with the wedge member facing in a proper, forward direction. This feature advantageously prevents the inadvertent front-to-rear installation reversal of the flex pin.

Additionally, in this modified version of the improved flex pin, the wedge member has an elongated longitudinally intermediate portion having an essentially flat front side surface adapted to be engaged along its length by a front side surface portion of the adapter nose opening, and a pair of rearwardly swept outer end portions which underlie opposite end surfaces of the locking member recess. Further, in this version of the improved flex pin the retention means for captively retaining the pin in the tooth point and adapter nose openings comprise an elongated, rearwardly projecting detent portion formed on the locking member body and adapted to underlie opposite rear wall portions of the tooth point.

The present invention also provides an alternate embodiment of the improved flex pin in which the locking member has a generally cylindrical configuration and is adapted to be driven axially into aligned circular openings formed through the tooth point and adapter nose. The elongated recess is formed laterally through a front side surface portion of the cylindrical locking member, so that the recess defines an internal cavity within the locking member, and the resilient means comprise an elongated elastomeric element extending longitudinally along the rear side surface of the recess. The elongated wedge member, which is adapted to be moved laterally into the recess, is essentially straight, and has opposite outer end surfaces which underlie the opposite end surfaces of the elongated recess. Formed on opposite end portions of the front side surface of the wedge member are a pair of forwardly projecting detent portions adapted to overlie opposite exterior side surface portions of the adapter nose to thereby captively retain the flex pin within the tooth point and adapter nose openings.

Extending rearwardly from the rear side surface of the wedge member are a longitudinally spaced series of projections which bear at their outer ends against the elongated elastomeric element. As the wedge member is driven laterally into the locking member recess it eventually reaches an inner limit position in which the forwardmost portion of the wedge member is aligned with the forward locking member side surface portion through which the recess extends, and the outer ends of the wedge member projections are spaced forwardly from the rear side surface of the locking member depression.

At this point a forward side surface portion of the adapter nose opening is brought to bear against the forward side surface of the locking member, along essentially the entire length thereof, to prevent further lateral movement of the wedge member into the locking member recess. Such locking member forward side surface thus functions as stop means for preventing appreciable bending loads on the wedge member since its inward movement is halted before it laterally bottoms out within the locking member recess. The projections on the wedge member, in this instance, do not function as stop means. Instead, they function only to engage and compress the elastomeric element, and to define recesses therebetween into which spaced portions of the compressed elastomeric element can be forwardly displaced as the wedge member is moved toward its inner limit position.

Because rigid bending forces on the wedge member are essentially eliminated, the front-to-rear thickness of the wedge member may be significantly reduced compared to wedge members in flex pins of conventional construction. This, of course, permits the elastomeric element to be concomitantly thickened without enlargement of the adapter nose pin opening.

A variety of modifications could be made to this alternate embodiment of the improved flex pin, if desired. For example, the wedge member projections could be deleted and replaced with forwardly extending projections formed on the rear side surface of the recess, with the elastomeric element being secured to the now flat rear side surface of the wedge member. Or, if desired, the projections could be eliminated altogether and the elastomeric member intersecured between the facing side surfaces of the recess and the wedge member, with appropriately spaced displacement openings being formed laterally through the elastomeric element. Finally, while the cylindrical configuration of the locking member is particularly well suited to smaller excavating tooth and adapter assemblies, the locking member could alternatively be provided with an elongated rectangular cross-section, with the recess being extended into one of the narrower side surfaces thereof, to accommodate larger assembly sizes.

DETAILED DESCRIPTION

Figure 1:
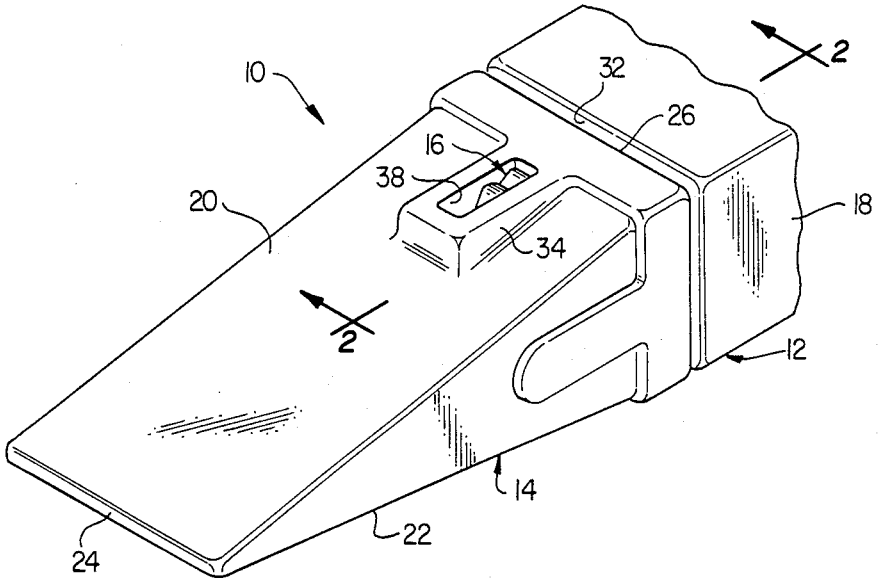
FIG. 1 is a perspective view of a front portion of an excavating tooth and adapter assembly in which a replaceable tooth point is releasably secured to an adapter nose by an improved resilient flex pin that embodies principles of the present invention.

Perspectively illustrated in FIG. 1 is a forward end portion of an excavating tooth and adapter assembly 10 which includes an adapter portion 12, and a replaceable tooth point 14 which is removably secured to the adapter by means of a unique resilient flex pin 16 that embodies principles of the present invention. The adapter 12 has a rearwardly disposed base portion 18 which may be suitably secured to the lower forward lip of an excavating bucket or the like (not illustrated) to support the point 14 in a forwardly projecting orientation relative to the bucket lip. Together with other similar tooth and adapter assemblies, the assembly 10 defines the digging tooth portion of the overall excavating apparatus.

Figure 2:
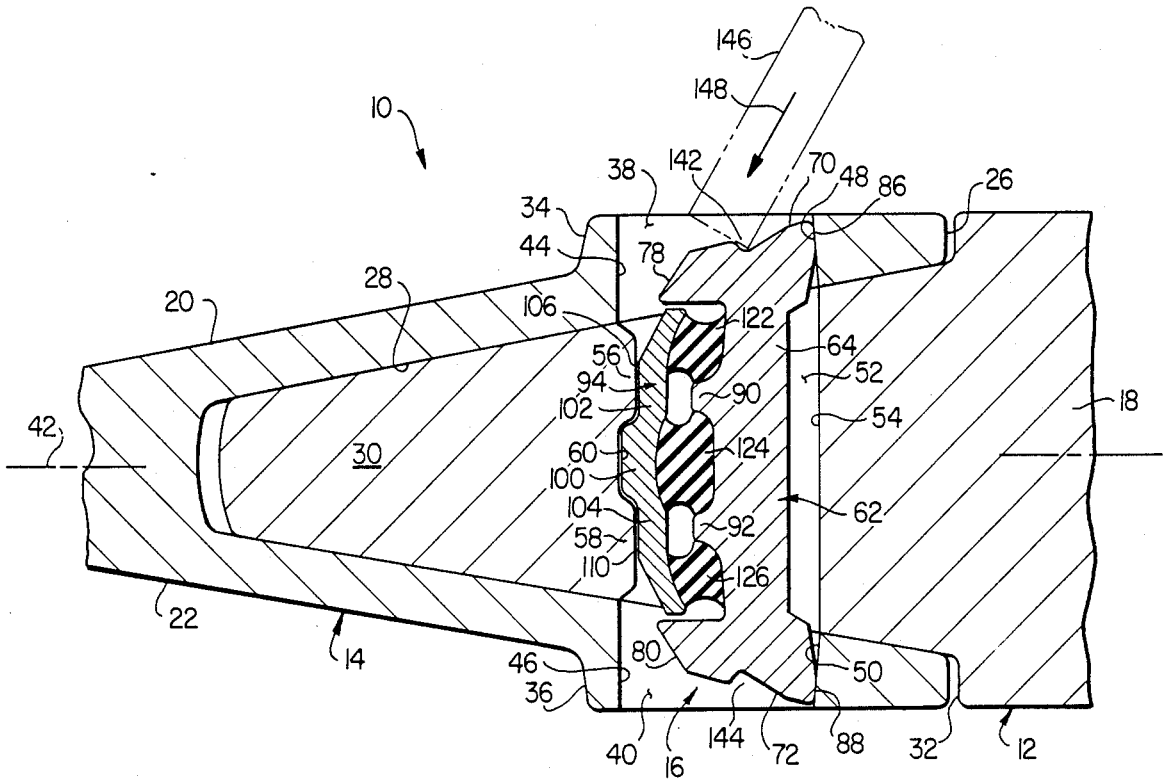
FIG. 2 is an enlarged scale cross-sectional view through the assembly portion taken along line 2—2 of FIG. 1.

Referring now to FIGS. 1 and 2, the point 14 is provided with vertically tapered upper and lower side wall portions 20 and 22 which converge at the forward end of the point 14 to define thereon a cutting edge 24. Extending forwardly through the rear end 26 of the point 14 is a vertically tapered pocket opening 28 that receives a complementarily tapered nose portion 30 which projects forwardly from the adapter base 18 and defines therewith a forwardly facing peripheral shoulder portion 32 that faces and is spaced slightly rearwardly from the rear end 26 of the point 14.

The point 14 is respectively provided along its upper and lower side walls 20 and 22 with raised reinforcing portions 34 and 36 through which aligned, generally rectangularly cross-sectioned openings 38 and 40 are respectively formed. Openings 38 and 40 are elongated in a direction parallel to the longitudinal axis 42 of the assembly 10 and have forward end surfaces 44 and 46 which are generally perpendicular to axis 42, and forwardly and outwardly sloped rear surfaces 48 and 50. Aligned with the tooth point openings is a generally rectangularly cross-sectioned opening 52 extending vertically through the adapter nose 30. Opening 52 has an essentially flat rear end wall 54, and a forward end wall which is provided adjacent its upper and lower ends (as viewed in FIG. 2) with a pair of rearwardly projecting protuberances 56 and 58 which define therebetween a central detent depression 60. The improved flex pin 16 is received in the aligned tooth and adapter nose openings 38, 40 and 52 and functions in a manner subsequently described to captively retain the tooth point 14 on the adapter nose 30 and prevent its leftwardly directed separation therefrom.

Figure 3:
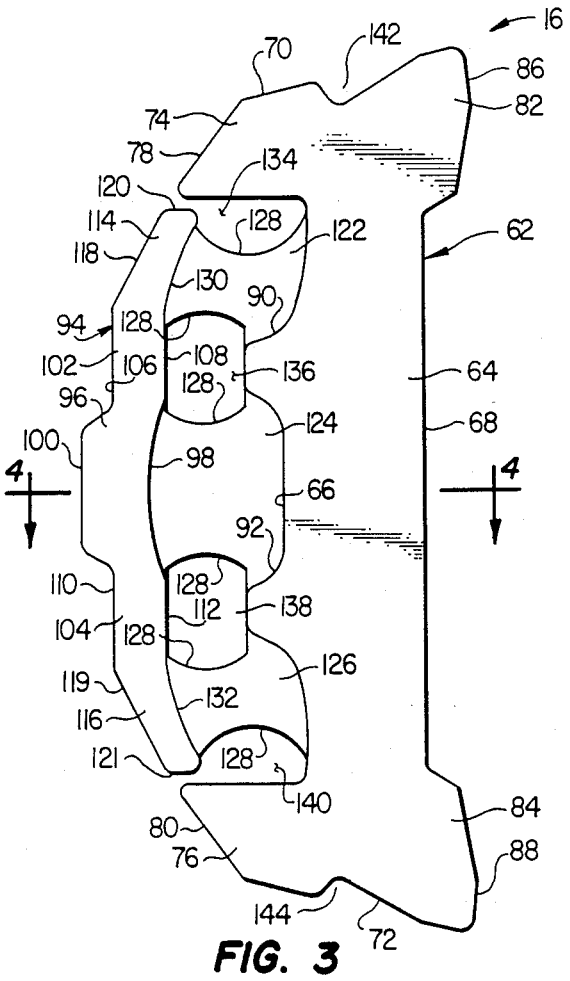
FIG. 3 is an enlarged scale side elevational view of the flex pin with its internal resilient portion in an uncompressed condition.
Figure 4:
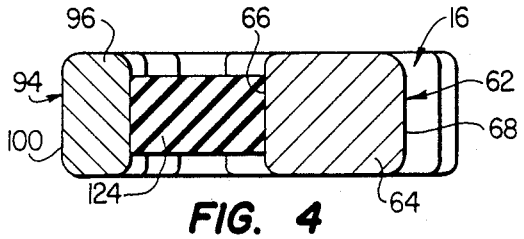
FIG. 4 is a cross-sectional view through the flex pin taken along line 4—4 of FIG. 3.

Referring now to FIGS. 3 and 4, the flex pin 16 includes a metal locking member 62 having an elongated body portion 64 with forward and rear side surfaces 66 and 68 extending along its length. Body 64 has formed thereon transverse upper and lower end portions 70 and 72 which project forwardly and rearwardly beyond the body side surfaces 66 and 68. The forwardly projecting sections 74 and 76 of end portions 70, 72 are provided with forwardly and longitudinally inwardly sloped outer end surfaces 78 and 80, while the rearwardly projecting sections 82 and 84 of the end portions 70, 72 are provided at their outer ends with forwardly and longitudinally outwardly sloped outer end surfaces 86 and 88. As can best be seen in FIG. 3, the sections 74 and 76 define with the body 64 a forwardly and laterally opening recess within the lock member 62, the facing side surfaces of the projections 74, 76 defining opposite end surfaces of the recess, and the body side surface 66 defining a rear or inner side surface of such recess.

A pair of stop portions 90 and 92 project forwardly from the side surface 66 of the locking member body 64 into this recess, such stop portions being considerably shorter than the forwardly projecting outer end sections 74 and 76. The stop portions 90, 92 are longitudinally spaced from one another, and are respectively spaced equal distances inwardly from the forwardly projecting end sections 74 and 76 of the body end portions 70 and 72.

The flex pin 16 also includes an elongated metal wedge member 94 which has a generally rectangular cross-section with a front-to-rear thickness substantially less than that of the locking member body portion 64, and a lateral thickness (i.e., the vertical thickness as viewed in FIG. 4) substantially identical thereto. Wedge member 94 has a longitudinally central portion 96 which has a concavely curved rear surface 98 and defines a forwardly projecting central detent portion 100 of the wedge member 94, the detent 100 being complementarily configured relative to the detent depression 60 (FIG. 2) formed in the forward wall of the adapter base opening 52. Central portion 96 is positioned between vertically extending, essentially straight upper and lower longitudinally intermediate bearing portions 102 and 104 which are respectively aligned with the stop portions 90, 92 and are spaced forwardly therefrom. Upper bearing portion 102 has essentially flat front and rear surfaces 106 and 108, while lower bearing portion 104 has essentially flat front and rear surfaces 110 and 112.

At the outer ends of the bearing portions 102 and 104, respectively, are a pair of rearwardly and outwardly swept end sections 114 and 116 which have essentially flat front side surfaces 118 and 119. The outer end surfaces 120 and 121 of the end sections 114 and 116 underlie and are spaced slightly inwardly from the forwardly projecting sections 74 and 76 of the locking member 62.

The locking and wedge members 62 and 94 are intersecured by means of three resilient members in the form of neoprene segments 122, 124 and 126 which, as best illustrated in FIG. 4, are laterally thinner than the locking and wedge members, and are laterally centered relative thereto. Each of the three neoprene segments has concave side surfaces 128 and is suitably bonded at its opposite ends to generally facing surface portion of the locking and wedge members. Specifically, segment 122 is bonded at one end to the rear side surface 130 of the wedge member end section 114, and at its other end to the lock member forward side surface 66 between the stop portion 90 and the forwardly projecting section 74; the segment 124 is bonded at one end to the curved rear surface 98 of the wedge member central portion 96, and at its other end to the lock member side surface 66 between the stop portions 90 and 92; and the segment 126 is bonded at one end to the rear side surface 132 of the wedge member end section 116, and at its other end to the lock member side surface 66 between the stop portion 92 and the forwardly projecting lock member section 76.

The neoprene segments 122, 124 and 126 are in a mutually spaced relationship so that the resilient internal portion of the flex pin 62 which such segments define is provided with a series of voids or laterally extending openings 134, 136, 138 and 140 therein. In FIGS. 3 and 4, the flex pin 62 is illustrated with its internal resilient portion in a totally uncompressed condition with the individual resilient segments 122, 124 and 126 in the configurations which they assume when the flex pin 62 is removed from the tooth and adapter assembly 10. Specifically, the central portion 96 of the wedge member and its adjacent bearing portions 102 and 104 are positioned forwardly of the projecting locking member sections 74 and 76, the rear bearing portion surfaces 108 and 112 are spaced forwardly of the stop portions 90 and 92, and the outer ends 120 and 121 of the wedge member underlies the forwardly projecting locking member end sections 74 and 76.

Referring again to FIG. 2, to install the flex pin 16, the adapter nose 30 is inserted into the tooth point pocket 28 to bring the point openings 38 and 40 into general alignment with the adapter nose opening 52. The flex pin 16 is then driven downwardly through the upper point opening 38 into the openings 52 and 40 below. As the pin is being downwardly driven in this manner, the adapter nose wall protuberance 56 engages the sloped lower forward side surface 119 of the wedge member 94 and forces the wedge member rearwardly toward the lock member body 64 within the locking member recess, and begins to compress the resilient neoprene segments of the flex pin. As the pin is driven further downwardly, the adapter nose protuberance 56 engages the wedge member central detent 100 and drives it further rearwardly toward the lock member body, thereby further compressing the neoprene segments. After the detent 100 clears the protuberance 56 the neoprene segments resiliently urge the detent 100 into the adapter nose detent depression 60 as the pin 16 is brought to its final position within the assembly 10.

During the downward driving of the flex pin into the generally aligned point and adapter nose openings, the upper end 120 of the wedge member is forced against the undersurface of locking member end section 74, thereby limiting the upward longitudinal movement of the wedge member relative to the locking member to prevent shearing of any of the neoprene segments. Of course, if desired, the flex pin 16 could alternatively be driven upwardly into the point and adapter nose openings. In such case, the lower wedge member end 121 would similarly cooperate with the lower locking member end section 76 to prevent the shearing of any of the neoprene segments.

With the flex pin 16 in its operative position depicted in FIG. 2, with the detent 100 received in its corresponding adapter nose depression 60, the sloped end surfaces 86 and 88 of the lock member 62 engage the sloped rear end surfaces 48 and 50 of the upper and lower point openings 38 and 40. It can be seen that with the pin 16 in its operative position, vertical dislodgement of the pin in either direction from the assembly 10 is precluded by the interengagement of the detent 100 and the upper and lower surfaces of its adapter nose depression 60. Flex pin 16 is dimensioned in a front-to-rear direction so that in the absence of axial loads on the tooth point 14, the neoprene segments 122, 124 and 126 are in a partially compressed position as illustrated in FIG. 2. This condition, of course, resiliently urges the detent 100 into its depression 60, and further urges the sloped end surfaces 86 and 88 of the lock member into firm engagement with the tooth opening surfaces 48 and 50.

It can also be seen in FIG. 2 that with the flex pin 16 in its installed position, the adapter nose protuberances 56 and 58 bear against the forward side surfaces 106 and 110 of the wedge member bearing portions 102 and 104, and are vertically aligned with the lock member stop portions 90 and 92. During use of the assembly 10 in the excavating process, the tooth point 14 is normally subjected to large leftward axial forces which, except for the presence of the flex pin 16, would dislodge the point 14 from the adapter nose 30. In common with conventional flex pins, the improved flex pin 16 of the present invention prevents such dislodgement of the tooth 14 from the adapter nose 30. However, as will now be described, the flex pin 16 has incorporated therein a variety of structural and operational improvements which make it stronger, more durable, and more efficient than conventional resilient flex pins of approximately the same overall size.

When large, leftwardly directed tooth point removal forces are encountered during the excavating process, the sloped rear surfaces 48 and 50 of the tooth point openings 38 and 40 exert leftwardly directed forces on the similarly sloped end surfaces 86 and 88 of the locking member 62 to thereby move the locking member 62 leftwardly within the adapter nose opening 52. This leftward movement of the locking member 62 is resisted by the adapter nose opening protuberances 56 and 58 which respectively bear against flat forward side surfaces 106 and 110 of the longitudinally intermediate wedge member bearing portions 102 and 104.

Figure 3A:
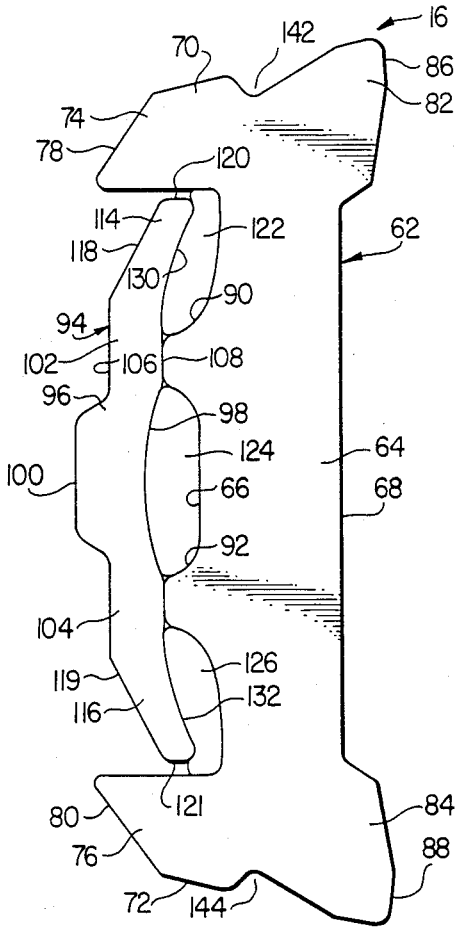
FIG. 3A is an elevational view similar to that in FIG. 3, but with the internal resilient portion of the flex pin being in its fully compressed state.

The resistive forces of these protuberances 56 and 58 forces the wedge member 94 further into the locking member recess against the resilient resistive forces of the neoprene segments 122, 124 and 126. Further leftward movement of the locking member 62 brings the front ends of the locking member stop portions into abutment with the rear side surfaces 108 and 112 of the wedge member bearing portions 102 and 104 as illustrated in FIG. 3A. At this point, such bearing portions 102 and 104 become pressed between the stop portions 90 and 92 and the protuberances 56 and 58 and function to prevent further leftward movement of the locking member 62 relative to the adapter nose 30.

Figure 4A:
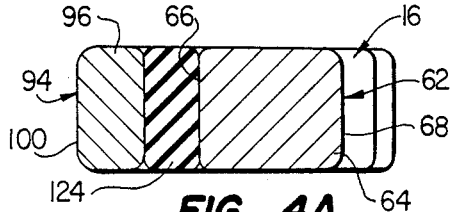
FIG. 4A is a cross-sectional view similar to that in FIG. 4, but with the internal resilient portion of the flex pin being in its fully compressed state.

When this occurs, the neoprene segments 122, 124 and 126 are brought to their maximum state of compression and, as best illustrated in FIG. 3A, have been laterally displaced to fully fill the voids or openings 134, 136 and 138. Such voids are conveniently sized so that when the flex pin 16 reaches its fully flexed position, with the wedge member moved laterally to its inner limit position within the locking member recess as depicted in FIG. 3A, the neoprene segments are made to essentially completely fill these voids without laterally bulging beyond the upper and lower side surfaces of the locking and wedge members 62, 94 as best illustrated in FIG. 4A. It can be seen that the stop portions 90, 92 function not only to limit the leftward travel of the locking member 62 relative to the adapter nose 30, but also prevent overcompression of the neoprene segments which might otherwise cause structural failure thereof.

With the flex pin 16 in its fully flexed position, (FIG. 3A) it can also be seen that the upper end sections 114 and 116 of the wedge member 94 are still spaced forwardly of the locking member body 64 within the locking member recess. These outer end sections of the wedge member 94 are not rigidly engaged by either the adapter nose 30 or the locking member 62. Instead, only a longitudinally intermediate portion of the wedge member 94 (i.e., the central wedge member portion 96 and its adjacent bearing portions 102, 104) is rigidly engaged by these two elements when the flex pin 16 is in its fully flexed position with the wedge member at its inner limit position. Stated in another manner, the rigid stop portions 90, 92 stop the inward travel of the wedge member before it laterally bottoms out against any surface portion of the locking member recess.

Because of this unique structural feature of the present invention, rigid bending forces on the wedge member 94 are essentially eliminated. More specifically, with the flex pin in its fully flexed position, the wedge member outer end portions 114 and 116 are subjected only to resilient bending forces (created by the neoprene segments 122 and 126), while the remaining longitudinally intermediate portion of the wedge member is subjected only to rigid compressive forces and the relatively minor resilient bending forces of the three neoprene segments.

Because of this unique absence of rigid bending forces on the wedge member 94, it may be fabricated with a substantially smaller front-to-rear thickness compared to conventional wedge members which, for example, are brought into engagement with the locking member body along their outer ends. This reduction in the front-to-rear thickness of the wedge member 94 permits the front-to-rear thickness of the locking member body 64 and/or the neoprene segments 122, 124 and 126 to be increased without increasing the overall front-to-rear dimension of the flex pin 16.

Since it is well known that the primary structural strength in flex pins of this general type reside in their locking member portions, and that the overall structural strength of an adapter nose is inversely related to the cross-sectional size of the pin opening extending therethrough, it can readily be seen that the ability provided by the present invention to increase the front-to-rear thickness of the locking member body 64, while at the same time, reducing such thickness in the wedge member 94, renders the flex pin 16 significantly stronger than conventional flex pins of this general type having the same overall front-to-rear thickness. Accordingly, given the same size adapter nose opening, the flex pin 16 provides a stronger resistance against axial tooth point dislodgement than would a conventional flex pin operatively installed in the same adapter nose opening.

To remove the flex pin 16 from the assembly 10, the flex pin is simply pounded downwardly through the aligned tooth point and adapter nose openings 38, 52 and 40 until the pin is driven outwardly through the lower tooth point opening 40. This removal technique is significantly facilitated in the present invention by the provision in the upper and lower end portions 70 and 72 of the locking member 62 of longitudinally inwardly extending guide notches 142 and 144. As best illustrated in FIG. 2, when pounding the flex pin 16 downwardly through the tooth point and adapter nose openings, part of a lower end portion of a drift 146 or other driving member may be rested in the upper end notch 142 and then pounded downwardly at a forwardly inclined angle as represented by the arrow 148 to drive the flex pin downwardly until the detent 100 is moved out of and downwardly past its associated adapter nose depression 60. The notch 142 helps to retain contact between the drift and the locking member 62 to inhibit slippage of the drift relative to the locking member. The lower end notch 144 functions in a similar manner when the flex pin 16 is being removed by pounding it upwardly through the aligned tooth point and adapter nose openings.

Figure 5:
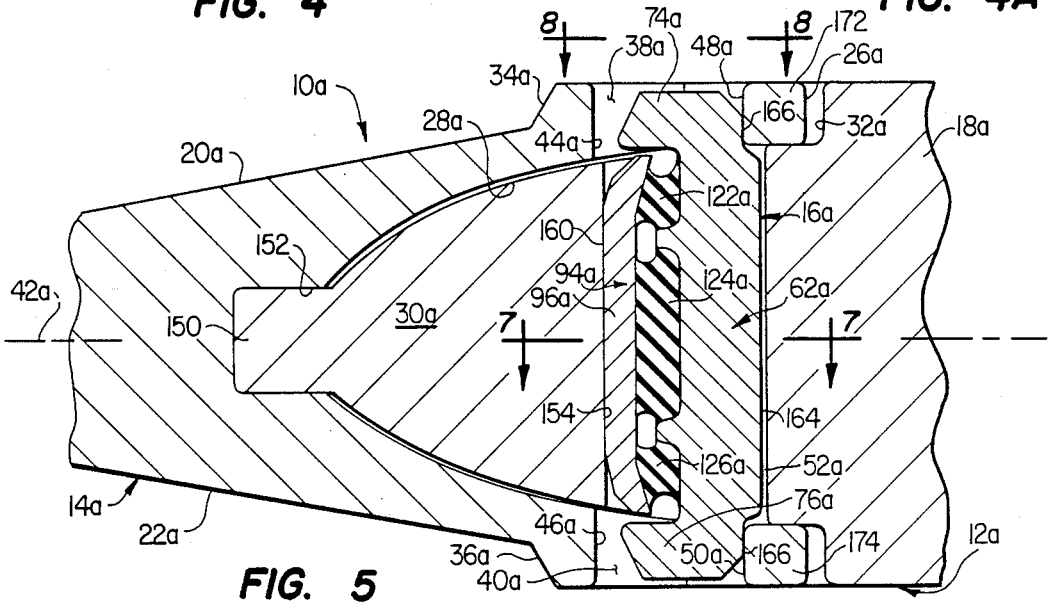
FIG. 5 is a cross-sectional view through a front portion of an excavating tooth and adapter assembly which utilizes an alternate embodiment of the improved resilient flex pin of the present invention.
Figure 6:
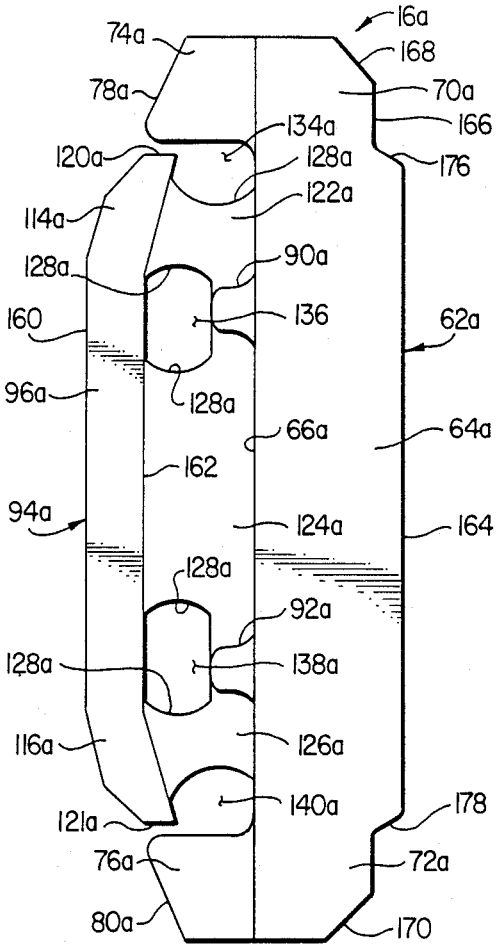
FIG. 6 is an enlarged scale side elevational view of the flex pin of FIG. 5 with its internal resilient portion in an uncompressed condition.
Figure 7:
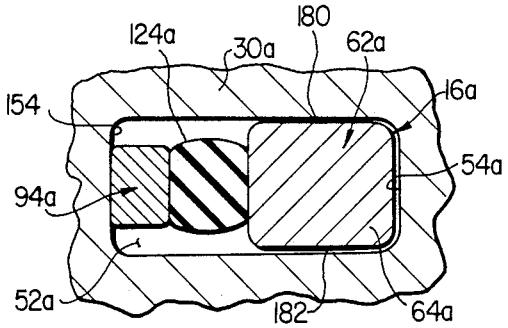
FIG. 7 is an enlarged scale cross-sectional view through the flex pin, and an adjacent portion of the adapter nose through which it extends, taken along line 7—7 of FIG. 5.
Figure 7A:
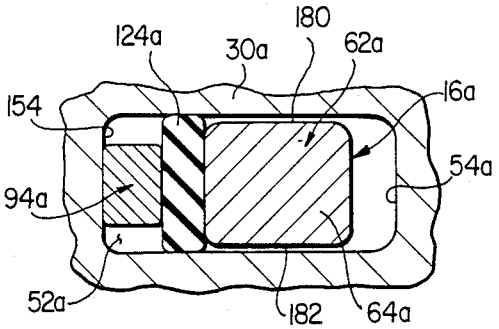
FIG. 7A is a cross-sectional view similar to that in FIG. 7, but with the internal portion of the flex pin being in its fully compressed state.
Figure 8:
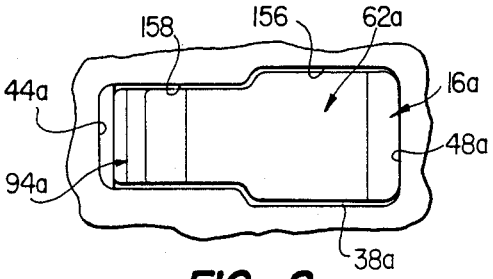
FIG. 8 is an enlarged scale top plan view of a rear portion of the replaceable tooth point cross-sectionally depicted in FIG. 5, taken along elevation line 8—8, and illustrates one of the two pin-receiving openings formed through the point.

Illustrated in FIGS. 5–8 is a slightly modified embodiment $16_a$ of the flex pin 16 which, in FIG. 5, is shown installed in a slightly differently configured tooth and adapter assembly $10_a$. Components in the assembly $10_a$ and the flex pin $16_a$ similar to those in the assembly 10 and flex pin 16 have been given identical reference numerals but with the subscript "a". The tooth point **14*a* has a pocket 28*a* formed therein which has, at its forward end, a reduced cross-section stabilizing portion 150. Pocket portion 150 receives a complementarily configured stabilizing end portion 152 formed on the adapter nose $30_a$. The adapter opening $52_a$, as illustrated in FIGS. 7 and 7A, is of a generally rectangular cross-section which is elongated in a front-to-rear direction and has essentially flat front and rear end surfaces 154 and $54_a$. The upper and lower tooth point openings $38_a$ and $40_a$ are provided with rear portions 156 which are of essentially the same width as the adapter nose opening $52_a$, and front portions 158 (FIG. 8) which are somewhat narrower. The front end surfaces $44_a$, $46_a$ and the rear end surfaces 48*a*, 50*a* of the tooth point openings 38*a*, 40*a*** are essentially perpendicular to the assembly axis $42_a$.

Referring now to FIGS. 6 and 7, the flex pin $16_a$ has a locking member $62_a$ whose elongated body portion $64_a$ is provided at its outer ends $70_a$ and $72_a$ with a pair of forwardly projecting sections $74_a$ and $76_a$ which are laterally thinner than the body portion $64_a$ (i.e., vertically shorter as viewed in FIG. 7). The sections $74_a$ and $76_a$ are provided with forwardly and inwardly sloped end surfaces $78_a$ and $80_a$. As in the case of the previously described locking member body portion 64, the body portion $64_a$ has formed thereon a pair of stop portions which project forwardly from the front side surface $66_a$ of the body portion $64_a$, the stop portions $90_a$ and $92_a$ being laterally narrowed in the same manner as the forwardly projecting locking member sections $74_a$ and $76_a$.

The flex pin $16_a$ is also provided with a laterally narrowed, elongated wedge member $94_a$ having a longitudinally intermediate portion $96_a$ which extends between rearwardly and outwardly swept opposite upper and lower end portions $114_a$ and $116_a$ whose outer ends $120_a$ and $121_a$ underlie the forwardly projecting locking member sections $74_a$ and $76_a$. The central portion $96_a$ of the wedge member $94_a$ is provided with essentially flat forward and rear side surfaces 160 and 162.

The wedge member $94_a$ is secured to the locking member body portion $64_a$ by means of three neoprene segments $122_a$, $124_a$ and $126_a$, each of these segments having concave side surfaces $128_a$. Segment 122 is bonded at its opposite ends to the upper wedge member end section $114_a$ and the front side surface $66_a$ of the locking member between the stop member $90_a$ and the forwardly projecting section $74_a$; segment $124_a$ is bonded at its opposite ends to the rear side surface 162 of the wedge member body portion $96_a$ and the front side surface $66_a$ of the locking member body $64_a$ between the stop portions $90_a$ and $92_a$; and the segment $126_a$ is bonded at its opposite ends to the lower end section $116_a$ of the wedge member and to the front side surface $66_a$ of the locking member body between the lower stop portion $92_a$ and the lower forwardly projecting section $76_a$. As in the previously described flex pin 16, these three neoprene segments define in the locking member recess a series of laterally extending voids or openings $134_a$, $136_a$, $138_a$ and $140_a$.

The retention means on the flex pin $16_a$ are not associated with the wedge member $94_a$, but with the locking member $62_a$ and take the form of an elongated detent portion 164 projecting rearwardly from the rear side surface 166 of the locking member body $64_a$. As best illustrated in FIG. 6, the detent portion 164 is positioned slightly inwardly of longitudinal end portions of this rear surface 166 which terminate at rearwardly and longitudinally inwardly sloped surfaces 168 and 170 formed on the upper locking member end portions $70_a$ and $72_a$.

Other than the repositioning of the detent means, and the lateral narrowing of the previously described front side portion thereof, the flex pin $16_a$ is similar in structure and operation to the flex pin 16. To install the flex pin $16_a$ in the assembly $10_a$, a lower end portion of the flex pin $16_a$ is inserted into the upper tooth point opening $38_a$ so that the laterally narrowed front portion of the flex pin is received in the laterally narrowed portion 158 (FIG. 8) of the tooth point opening $38_a$. This narrowing of the portion 158 of the tooth point opening $38_a$ (or the similar narrowing of a portion the lower tooth point opening $40_a$ when the flex pin is installed in an upward direction therethrough) acts as a "key" to prevent the inadvertent reversal of the flex pin within the assembly $10_a$.

The flex pin $16_a$ is then pounded downwardly into the aligned openings $38_a$, $52_a$ and $40_a$ until the detent 164 pops rearwardly into the pocket space between upper and lower rear portions 172 and 174 (FIG. 5) of the tooth point $22_a$. In this position, upper and lower detent end surfaces 176 and 178 (FIG. 6) underlie the rear end portions 172, 174 and captively retain the flex pin $16_a$ within the assembly $10_a$. With the flex pin $16_a$ in its installed position depicted in FIG. 5, the upper and lower tooth point portions 172, 174 bear against the upper and lower rear surface portions 166 of the locking member, and the flat front end surface of the adapter nose opening $52_a$ bears against the flat front surface 160 of the longitudinally central portion $96_a$ of the wedge member $94_a$.

Figure 6A:
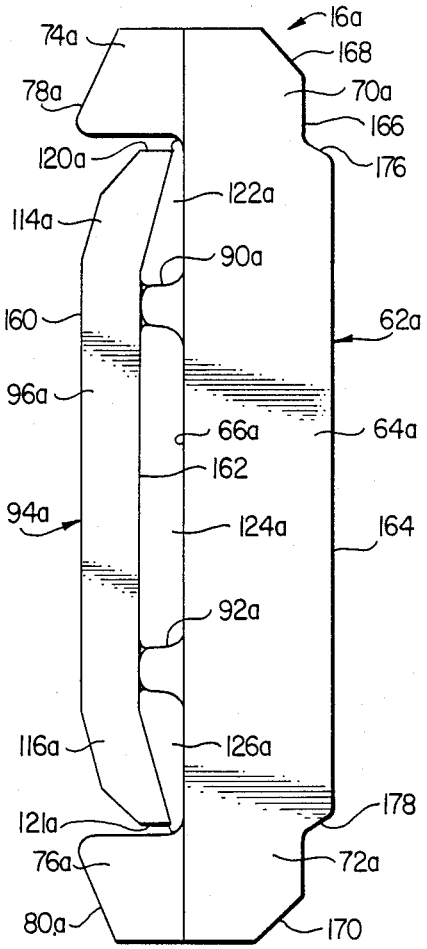
FIG. 6A is an elevational view similar to that in FIG. 6, but with the internal resilient portion of the flex pin being in its fully compressed state.

Leftwardly directed tooth point removal forces cause a concomitant leftward movement of the locking member $62_a$ toward the wedge member $94_a$ until, as depicted in FIG. 6A, the wedge member is brought to its inner limit position within the locking member recess the stop portions $90_a$ and $90_b$ are driven into engagement with the flat rear surface 162 of the longitudinally intermediate portion $96_a$ of the wedge member $94_a$. This causes lateral displacement of the neoprene segments $122_a$, $124_a$ and $126_a$ to completely fill the voids $134_a$, $136_a$, $138_a$ and $140_a$, and further causes each of such neoprene segments to bulge laterally outwardly (FIG. 7A) into general alignment with the opposite lateral side surfaces 180, 182 of the body portion $64_a$ of the locking member $62_a$.

As in the case of the previously described flex pin 16, in the wedge member position depicted in FIG. $6_a$ the rearwardly swept outer end portions $114_a$ and $116_a$ are forwardly spaced from the front side surface $66_a$ of the locking member $62_a$ and are not engaged by any rigid portion of the assembly $10_a$. The central portion $96_a$ of the wedge member $94_a$ is pressed between the stop portions $90_a$, $90_b$ and the flat front end surface 154 of the adapter nose opening $52_a$. Accordingly, as in the case of the previously described flex pin 16, the wedge member $94_a$ is not subjected to any rigid bending forces, and thus may be given a front-to-rear thickness substantially less than that in conventional wedge members.

While the internal rigid stop portions in both the flex pin 16 and flex pin $16_a$ have been illustrated as being formed on or otherwise associated with the locking member portion of the flex pin, it will be readily appreciated that, if desired, they could alternatively be formed on the longitudinally intermediate portions of the wedge members if desired. Alternatively, the rigid internal stop means defined by such stop portions could alternatively be defined by rigid stop elements which were suitably imbedded in, or otherwise carried by the neoprene segments instead of being secured to either of the two rigid portions of the flex pin. Additionally, a variety of differently configured and positioned retention means (such as detents and/or depressions) could alternately be employed to captively retain the particular flex pin within its associated tooth point and adapter assembly.

Illustrated in FIGS. 9–12 is a further alternate embodiment $16_b$ of the flex pin 16, the modified flex pin $16_b$ being incorporated in an excavating tooth and adapter assembly $10_b$ (FIG. 9) which, except for the differences noted below, is substantially identical to the previously described assembly 10. Elements in the assembly $10_b$ and the flex pin $16_b$ similar to those in assembly 10 and flex pin 16 have been given identical reference numerals, but with the subscript "b". Unlike their rectangular counterparts in the assembly 10, the tooth point and adapter nose openings $38_b$, $40_b$ and $52_b$ have circular cross-sections. Additionally, the detent depression 60 is eliminated in the adapter nose $30_b$ so that the forwardly disposed surface 184 of the adapter nose opening $52_b$ is unindented.

Figure 9:
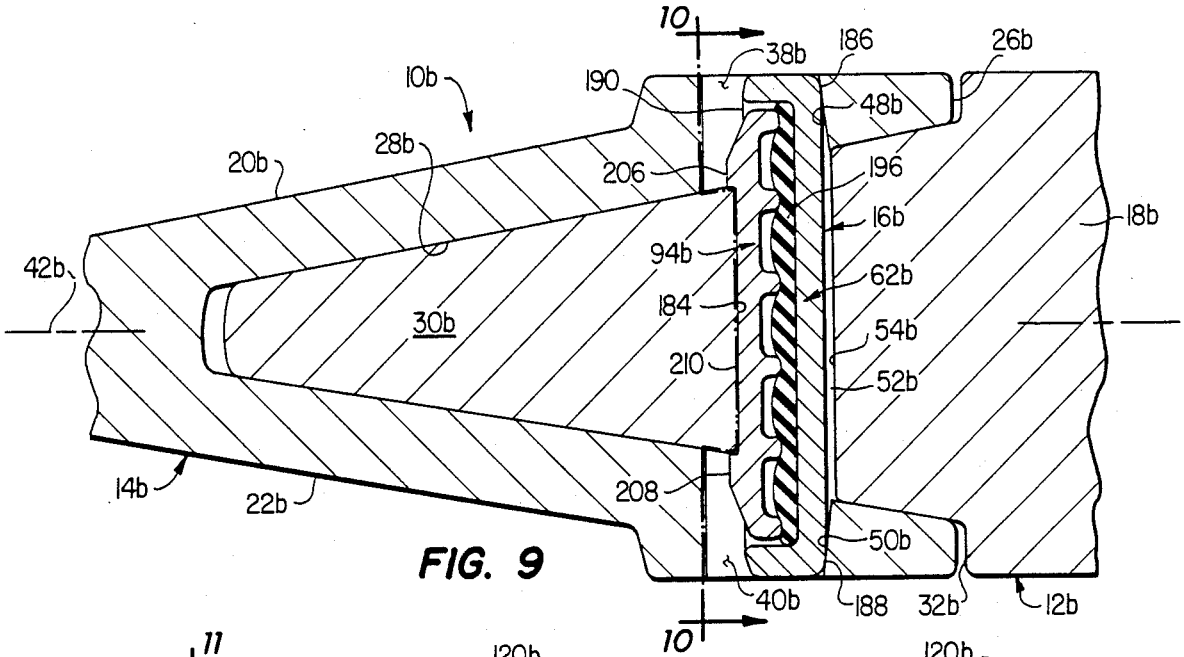
FIG. 9 is a cross-sectional view through a front portion of an excavating tooth and adapter assembly which utilizes a further alternate embodiment of the improved resilient flex pin of the present invention.
Figure 10:
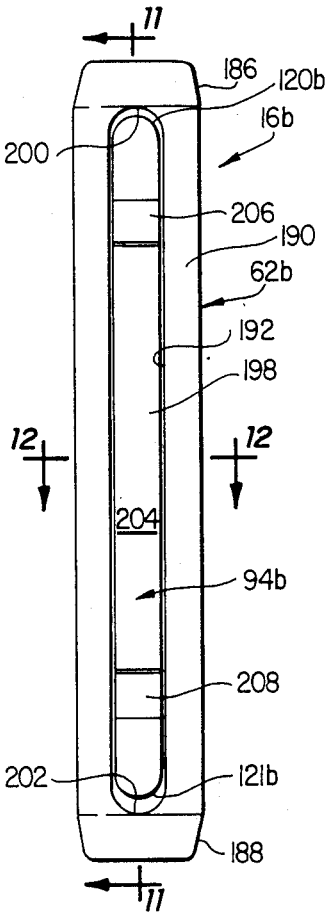
FIG. 10 is an enlarged scale front elevational view of the flex pin of FIG. 9, taken along elevation line 10—10 thereof.

The flex pin $16_b$ has an elongated, circular cylindrical locking member $62_b$ with tapered upper and lower end portions 186 and 188 which, as best illustrated in FIG. 9, bear against the sloping rear side surfaces $48_b$ and $50_b$ of the tooth point openings $38_b$ and $40_b$. The locking member $62_b$ has formed through a curved front side surface portion 190 thereof a lateral recess 192 which defines an internal cavity within the locking member and terminates in a forwardly facing inner side wall surface 194 within the locking member $62_b$. An elongated, continuous segment of neoprene material 196 is received within the recess 192, extends along its length, and bears against its inner side surface 194.

Figure 11:
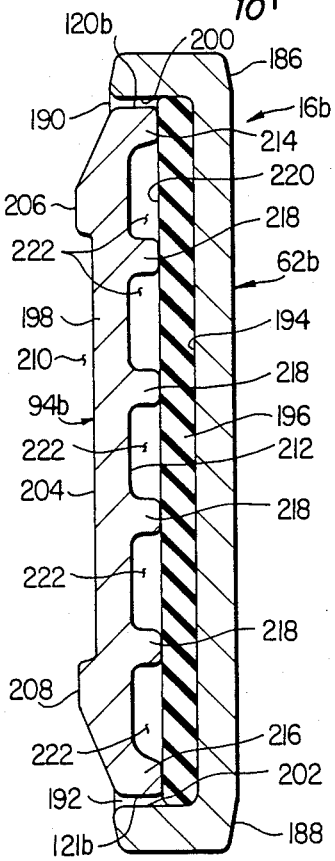
FIG. 11 is a cross-sectional view through the flex pin taken along line 11—11 of FIG. 10, with the internal resilient portion of the flex pin being in an uncompressed condition.

The elongated wedge member $94_b$ has a straight body portion 198 whose opposite outer end surfaces $120_b$ and $121_b$ underlie the opposite upper and lower end surfaces 200 and 202 of the recess 192. Body portion 198 has an essentially flat, longitudinally intermediate front side surface 204 which is flanked by upper and lower forwardly directed end projections 206 and 208 that define with the surface portion 204 a central front detent recess 210 in the wedge member $94_b$. The body portion 198 of the wedge member $94_b$ also has an essentially flat, rearwardly facing side surface 212 extending along the length of the body portion 198. Extending rearwardly from this side surface 212 are a pair of opposite upper and lower end projections 214 and 216, and four equally spaced central projections 218. Each of these projections is firmly bonded at its rear end to the forwardly facing side surface 220 of the resilient neoprene element 196. As best illustrated in FIG. 11, these rearwardly extending projections define between adjacent pairs thereof laterally extending voids 222 in a rear side portion of the wedge member $94_b$. With the neoprene element 196 in its uncompressed condition illustrated in FIG. 11, the front projections 206 and 208, and the front side surface 204 of the wedge member $94_b$ are positioned somewhat forwardly of the front side surface 190 of the locking member $62_b$.

As in the case of the previously described flex pins 16 and $16_a$, the flex pin $16_b$ is installed in the assembly $10_b$ simply by pounding the flex pin $16_b$ downwardly into the generally aligned tooth point and adapter nose openings $38_b$, $52_b$ and $40_b$. When the flex pin $16_b$ is downwardly driven to its installed position depicted in FIG. 9, the forward wedge member projections 206 and 208 outwardly overlie upper and lower sloped side surface portions of the adapter nose $30_b$ to thereby function as detent means for captively retaining the flex pin $16_b$ within the tooth point and adapter nose openings. In this installed position, in the absence of axial loads upon the tooth point $22_b$, the continuous neoprene element 196 is in a partially compressed condition with spaced portions thereof being displaced forwardly into the wedge member voids 222 as illustrated in FIG. 9.

Upon the imposition of a leftwardly directed axial load on the tooth point $22_b$, the sloped point opening surfaces $48_b$ and $50_b$ drive the locking member $62_b$ leftwardly relative to the wedge member $94_b$, thereby causing the front surface 184 of the adapter nose opening $52_b$ to drive the wedge member further into the locking member recess 192. With sufficient leftward force on the tooth point $22_b$, this leftward movement of the locking member $62_b$, and the concomitant movement of the wedge member $94_b$ into the locking member recess 192, continues until the flat forward end surfaces 224 and 226 of the forward wedge member projections 206 and 208 are brought into alignment with the front side surface 190 of the cylindrical locking member $62_b$.

Figure 11A:
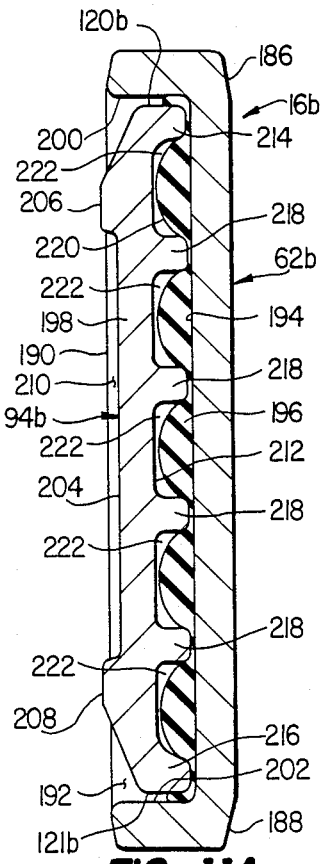
FIG. 11A is a cross-sectional view similar to that in FIG. 11, but with the internal resilient portion of the flex pin being in its fully compressed state.
Figure 12:
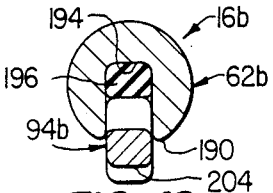
FIG. 12 is a cross-sectional view through the flex pin taken along line 12—12 of FIG. 10, with the internal resilient portion of the flex pin being in an uncompressed condition.
Figure 12A:
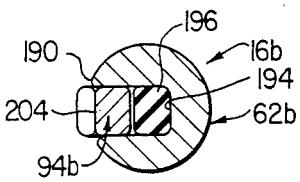
FIG. 12A is a cross-sectional view similar to that in FIG. 12, but with the internal resilient portion of the flex pin being in its fully compressed state.

At this point, the wedge member $94_b$ has been moved to its inner limit position within the locking member recess 192, and has not laterally bottomed out therein, and the front surface 184 (FIG. 9) of the adapter nose opening $52_b$ is brought to bear against the locking member front side surface 190 as best illustrated in FIGS. 11A and 12A. With the wedge member $94_b$ in this inner limit position, spaced apart portions of the neoprene element 196 have been moved further into the wedge member voids 222 and the outer ends of the rearwardly directed wedge member projections 214, 216 and 218 are spaced just forward of the inner side wall surface 194 of the recess 192.

It can thus be seen that in the flex pin $16_b$ these rearwardly directed wedge member projections do not serve as rigid stop means. Instead, they merely function to compress spaced apart portions of the neoprene element 196 and to define the voids 222 into which spaced apart portions of the neoprene elements may be forwardly displaced.

The rigid stop means in the flex pin $16_b$ are instead defined by the front side surface 190 of the locking member $62_b$. However, as in the case of the rigid stop means incorporated into the previously described flex pins 16 and $16_a$, the surface 190 functions to prevent the adapter nose opening surface 184 from exerting any appreciable rigid bending force upon the wedge member $94_b$ in its inner limit position since the movement of such wedge member into the locking member recess 192 is terminated by the engagement between the adapter nose opening surface 184 and the locking member side surface 190 before the wedge member $94_b$ is "bottomed out" against the interior side surface 194 of the locking member recess 192. Because of this unique prevention of rigid bending forces upon the wedge member $94_b$, its overall front-to-rear thickness may be made appreciably less, while the front-to-rear thickness of the locking member $62_b$ and/or the resilient element 196 can be increased relative to counterpart components in conventional resilient flex pins.

Figure 13:
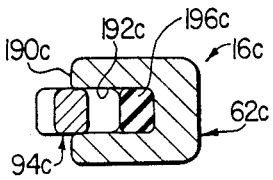
FIG. 13 is a cross-sectional view similar to that in FIG. 12 and illustrates a representative alternate cross-sectional configuration of the locking member portion of the flex pin depicted in FIG. 12.

The generally cylindrically configured locking member $62_b$ just described is particularly well suited for installations in relatively small excavating tooth and adapter assemblies. However, the same unique operating characteristics may also be incorporated into a somewhat stronger flex pin $16_c$ (FIG. 13), suitable for installation in larger sized excavating tooth and adapter assemblies, simply by replacing the cylindrical locking member $62_b$ with a locking member $62_c$ which has a rectangular cross-section that is elongated in a front-to-rear direction as illustrated in FIG. 13. A recess $192_c$ may then be formed inwardly through the front end surface $190_c$ of the rectangularly cross-sectioned locking member $62_c$, such recess receiving a somewhat larger neoprene element $196_c$, and a somewhat larger wedge member $94_c$ which is otherwise configured similarly to the previously described wedge member $94_b$. To utilize this larger rectangularly cross-sectioned flex pin $16_c$, it would, of course, be necessary to provide the tooth point and adapter nose openings with similarly elongated rectangular cross-sections.

The foregoing detailed description is to be clearly understood as given by way of illustration and example only, the spirit and scope of the present invention being limited solely by the appended claims.

What is claimed is:

1. Improved flex pin apparatus for captively retaining a tooth point on an adapter portion of an excavating tooth and adapter assembly, comprising:

an elongated rigid locking member having an elongated recess extending laterally through a side surface portion thereof, said recess having an inner side surface and a pair of opposite end surfaces;

an elongated rigid wedge member engageable by a portion of said assembly and being laterally drivable thereby transversely into said recess toward said inner side surface in response to relative movement between said tooth point and said adapter portion, said wedge member having opposite end portions which underlie said opposite end surfaces of said recess;

resilient means, interposed between said locking member and said wedge member, for resiliently resisting lateral movement of said wedge member into said recess; and rigid stop means, carried by a longitudinally central portion of one of said locking member and said wedge member and projecting laterally outwardly therefrom, for engaging a longitudinally central portion of the other of said locking member and said wedge member and stopping further lateral movement of said wedge member into said recess at an inner limit position of said wedge member in a manner limiting the overall compression of said resilient means while at the same time intermediately bracing said wedge member, and substantially inhibiting the creation of rigid bending forces thereon, when it is stopped in said inner limit position thereof.

2. The improved flex pin apparatus of claim 1 wherein:

said rigid stop means include a spaced duality of outwardly projecting portions formed on said inner side surface of said recess and operative to prevent said wedge member from laterally bottoming out against a surface portion of said recess.

3. The improved flex pin apparatus of claim 1 wherein:

said resilient means extend along essentially the entire length of said elongated recess and having a longitudinally spaced series of openings extending laterally therethrough and adapted to receive portions of said resilient means displaced when said wedge member is in said inner limit position thereof.

4. The improved flex pin apparatus of claim 3 wherein:

said resilient means include a longitudinally spaced series of elastomeric segments, the spaces between adjacent pairs of said segments defining said openings, and said rigid stop means include a pair of rigid members each positioned in a different one of said openings and interposed between a longitudinally intermediate portion of said wedge member and said inner side surface of said recess.

5. The improved flex pin apparatus of claim 4 wherein:

said pair of rigid members are defined by a pair of projecting portions formed on one of said wedge member and said inner side surface of said locking member recess.

6. The improved flex pin apparatus of claim 5 wherein:

said pair of projecting portions are formed on said inner side surface of said recess.

7. The improved flex pin apparatus of claim 4 wherein:

said openings are sized to be essentially completely filled with adjacent portions of said elastomeric segments resiliently displaced when said wedge member is brought to said inner limit position thereof.

8. The improved flex pin apparatus of claim 1 wherein:

a side portion of said flex pin apparatus is laterally narrowed relative to the balance of said flex pin apparatus.

9. The improved flex pin apparatus of claim 8 wherein:

said laterally narrowed side portion of said flex pin apparatus includes said wedge member.

10. The improved flex pin apparatus of claim 1 wherein:

said recess defines an internal cavity within said locking member, said wedge member and said recess are relatively dimensioned in a manner such that with said wedge member driven to said inner limit position by said portion of said assembly said wedge member is not laterally bottomed out within said recess and said portion of said assembly is brought into engagement with said side surface portion of said locking member, and said rigid stop means are defined by said side surface portion of said locking member.

11. The improved flex pin apparatus of claim 10 wherein:

said locking member has a generally circular cross-section.

12. The improved flex pin apparatus of claim 10 wherein:

said locking member has an elongated, generally rectangular cross-section, a pair of relatively wide opposite side surfaces, and a pair of relatively narrow opposite side surfaces, and said recess extends inwardly through a laterally central portion of one of said relatively narrow opposite side surfaces.

13. The improved flex pin apparatus of claim 10 wherein:

said resilient means include an elongated resilient member positioned in said recess and extending generally parallel to said inner side surface thereof, and one of said locking member and said wedge member has formed thereon a longitudinally spaced series of projections adapted to engage and compress longitudinally spaced portions of said resilient member when said wedge member is moved toward said inner limit position thereof, and to displace portions of said resilient member into the spaces between said projections.

14. The improved flex pin apparatus of claim 13 wherein:

said projections are formed on said wedge member and extend toward said inner side surface of said locking member recess, and said resilient member is interposed between the outer ends of said projections and said inner side surface of said locking member recess.

15. The improved flex pin apparatus of claim 1 wherein:

said tooth point and said adapter portion have generally alignable openings formed therethrough, said improved flex pin apparatus is axially drivable into said generally alignable openings, and said improved flex pin apparatus further comprises retention means for captively retaining said improved flex pin in said generally alignable openings.

16. The improved flex pin apparatus of claim 15 wherein:

said retention means comprise detent means, formed on one of said locking member and said wedge member, for cooperating with a complementarily configured portion of one of said tooth point and said adapter portion to captively retain said improved flex pin apparatus in said generally alignable openings.

17. The improved flex pin apparatus of claim 16 wherein:

said improved flex pin apparatus is axially drivable outwardly through said generally alignable openings, and said locking member has a notch formed in at least one end thereof and adapted to engage and retain an end of a driving tool to facilitate the axial driving of said improved flex pin apparatus.

18. An improved flex pin for captively retaining an excavating tooth point on an adapter portion of an excavating tooth and adapter assembly, said flex pin being adapted to be received in generally aligned openings formed through said tooth point and adapter portion, and comprising:

a rigid locking member having an elongated body with a side surface, and a pair of opposite end portions adapted to be engaged by a first portion of said assembly, said opposite end portions having sections projecting laterally beyond said side surface and defining therewith a laterally extending recess in said locking member;

an elongated rigid wedge member configured to be engaged only along a longitudinally intermediate portion thereof by a second portion of said assembly movable relative to said first portion thereof, said wedge member being laterally drivable by said second portion of said assembly into said locking member recess and having a pair of opposite end portions having outer ends which underlie said projecting end portion sections of said locking member, said longitudinally intermediate portion having a side surface which faces said side surface of said locking member body;

resilient means, disposed in said locking member recess, for resiliently resisting movement of said wedge member into said locking member recess;

rigid stop means, interposed between said side surfaces of said locking member body and a central portion of said longitudinally intermediate wedge member portion, for stopping movement of said wedge member into said locking member recess, caused by relative movement between said first and second assembly portions, at an inner limit position in which said side surface of said longitudinally intermediate portion of said wedge member is laterally spaced from said side surface of said locking member body to limit the overall compression of said resilient means between said locking member and said wedge members, and for intermediately bracing said wedge member in said inner limit position in a manner inhibiting the creation of rigid bending forces thereon by said second assembly portion; and retention means, associated with one of said locking member and said wedge member, for captively retaining said improved flex pin in said generally aligned openings.

19. The improved flex pin of claim 18 wherein:

said rigid stop means are operative to prevent said wedge member from laterally bottoming out against a surface portion of said locking member recess.

20. The improved flex pin of claim 19 wherein:

said rigid stop means comprise rigid projections means formed on one of said locking member and said wedge member and extending therefrom into said locking member recess.

21. The improved flex pin of claim 20 wherein:

said rigid projection means comprise a longitudinally spaced duality of projections formed on said inner side surface of said locking member recess and positioned to engage said longitudinally intermediate wedge member portion when said wedge member is in said inner limit position thereof.

22. The improved flex pin of claim 20 wherein:

said resilient means extend longitudinally along said locking member recess and have laterally extending opening means formed therethrough into which portions of said resilient means may be displaced when said wedge member is in said inner limit position thereof.

23. The improved flex pin of claim 22 wherein:

said rigid projections means extend into said opening means, and said opening means are sized to be essentially completely filled by displaced portions of said resilient means when said wedge member is in said inner limit position thereof.

24. The improved flex pin of claim 18 wherein:

said flex pin has, along its length, a laterally narrowed cross-sectional portion whereby, by complementarily configuring at least one of said openings in said tooth point and said adapter portion, front-to-rear reversal of said flex pin within said assembly may be avoided.

25. The improved flex pin of claim 24 wherein:

said laterally narrowed cross-sectional portion is a front side portion of said flex pin and includes said wedge member.

26. An improved flex pin for captively retaining an excavating tooth point on an adapter portion of an excavating tooth and adapter assembly, said flex pin being adapted to be received in generally aligned openings formed through said tooth point and adapter portion, and comprising:

an elongated rigid locking member having an exterior side surface portion extending along its length, and a pair of opposite end portions adapted to be engaged by a first portion of said assembly, a laterally central portion of said exterior side surface portion having an elongated recess formed therein, which defines and internal cavity within said locking member, said recess having an elongated inner side surface and a pair of opposite end surfaces;

an elongated rigid wedge member engageable by a second portion of said assembly and laterally movable thereby into said recess in response to relative movement between said first and second assembly portions, said wedge member having opposite ends which underlie said opposite end surfaces of said recess, said wedge member and said recess being relatively dimensioned in a manner such that said second assembly portion, during movement thereby of said wedge member into said recess, will engage and stop said exterior side surface portion of said locking member prior to causing said wedge member to laterally bottom out in said recess;

resilient means, disposed in said locking member recess, for resiliently resisting movement of said wedge member into said locking member recess; and retention means, associated with one of said locking member and said wedge member, for captively retaining said improved flex pin in said generally aligned openings, said resilient means including an elongated resilient member positioned in said recess and longitudinally extending generally parallel to said inner side surface thereof, and one of said locking member and said wedge member having formed thereon a longitudinally spaced series of lateral projections, including a plurality of longitudinally centrally disposed lateral projections, adapted to engage and compress longitudinally spaced portions of said resilient member when said wedge member is moved toward said inner limit position thereof, and to displace portions of said resilent member into the spaces between said projections.

27. The improved flex pin of claim 26 wherein:

said locking member has a generally circular cross-section.

28. The improved flex pin of claim 26 wherein:

said locking member has an elongated, generally rectangular cross-section, a pair of relatively wide opposite exterior side surfaces, and a pair of relatively narrow opposite exterior side surfaces, and

29. The improved flex pin apparatus of claim 26 wherein:

said projections are formed on said wedge member and extend toward said inner side surface of said locking member recess, and said resilient member is interposed between the outer ends of said projections and said inner said surface of said locking member recess.

30. An excavating tooth and adapter assembly comprising:

a replaceable tooth point having a front end, a rear end, an adapter nose pocket extending forwardly through said rear end and circumscribed by a laterally outer wall portion of said tooth point, and an aligned pair of pin openings formed through opposed sections of said laterally outer wall portions;

an adapter having a forwardly projecting nose portion receivable in said adapter nose pocket, said nose portion having a pin opening extending transversely therethrough which is positionable between an generally alignable with said tooth point pin openings; and a flex pin drivable into said pin openings of said tooth point and said adapter nose portion to captively retain said tooth point on aid adapter nose portion, said flex pin including:

an elongated rigid locking member having an elongated recess extending laterally through a side surface portion thereof, said recess having an inner side surface and a pair of opposite end surfaces, said locking member further having opposite end portions which are engageable by rear surface portions of said tooth point pin openings;

an elongated rigid wedge member engageable by a forward surface portion of said adapter nose portion pin opening and being laterally drivable thereby into said recess toward said inner side surface thereof in response to forward movement of said tooth point relative to said adapter nose portion, said wedge member having opposite end portions which underlie said opposite end surfaces of said recess;

resilient means, interposed between said locking member and said wedge member, for resiliently resisting lateral movement of said wedge member into said recess;

rigid stop means for engaging a longitudinally central portion of one of said locking member and said wedge member and stopping lateral movement of said wedge member into said recess at an inner limit position in which said wedge member is spaced laterally apart from said inner side surface of said recess to limit the overall compression of said resilient means, and for (supporting) rigidly bracing a longitudinally intermediate portion of said wedge member in said inner limit position in a manner inhibiting said forward surface portion of said adapter nose pin opening from creating rigid bending forces in said wedge member when it is in said inner limit position; and retention means, associated with one of said locking member and said wedge member, for cooperating with one of said tooth point and said adapter nose portion to captively retain said flex pin in said pin openings of said tooth point and said adapter nose portion.

31. The assembly of claim 30 wherein:

said rigid stop means include a duality of projections formed on one of said longitudinally intermediate wedge member portion and said inner side surface of said recess.

32. The assembly of claim 30 wherein:

said resilient means having opening means therein into which portions of said resilient means may be displaced when said wedge member is in said inner limit position thereof, said opening means being sized to be essentially entirely filled by portions of said resilient means when said wedge member is in said inner limit position thereof.

33. The assembly of claim 30 wherein:

said flex pin and at least one of said pin openings are complementarily configured in a manner preventing undesirable front-to-rear reversal of said flex pin within said pin openings.

34. The assembly of claim 33 wherein:

forward side portions of said pin openings in said tooth point, and a forward side portion of said flex pin, are laterally narrowed relative to the balances thereof.

35. The assembly of claim 30 wherein:

said recess defines an internal cavity within said locking member, and said rigid stop means are defined by said side surface portion of said locking member through which said recess laterally extends, said locking member and said recess being relatively dimensioned in a manner such that said forward surface portion of said adapter nose portion pin opening will engage said side surface portion of said locking member before driving said wedge member to a laterally bottomed out position within said recess.

36. The assembly of claim 35 wherein:

one of said wedge member and said inner side surface of said recess has formed thereon a longitudinally spaced series of projecting portions, and said resilient means comprise an elongated resilient member extending longitudinally parallel to said inner side surface of said recess and being interposed between the outer ends of said projecting portions and the other of said wedge member and said inner side surface of said recess.

37. The assembly of claim 30 wherein:

said pin openings in said tooth point and said adapter nose portion, and the cross-section of said locking member, have generally circular configurations.

38. The assembly of claim 30 wherein:

said pin openings in said tooth point and said adapter nose portion, and the cross-section of said locking member, have generally rectangular configurations elongated in a front-to-rear direction, and said side surface portion of said locking member, through which said recess extends, is a front side surface thereof.

* * * * *